US005687649A

United States Patent [19]

Koeninger et al.

[11] Patent Number: 5,687,649

[45] Date of Patent: Nov. 18, 1997

[54] MONORAIL TRACK STRUCTURE

[75] Inventors: Timothy A. Koeninger, Ft. Thomas; Weston R. Loomer, Walton, both of Ky.

[73] Assignee: HK Systems, Inc., New Berlin, Wis.

[21] Appl. No.: 630,514

[22] Filed: Apr. 10, 1996

[51] Int. Cl.[6] ..... E01B 25/24

[52] U.S. Cl. ..... 104/106; 104/111; 104/125; 104/126; 238/255

[58] Field of Search ..... 104/106, 107, 104/108, 109, 110, 111, 125, 126; 238/172, 175, 176, 243, 244, 255, 262

[56] References Cited

U.S. PATENT DOCUMENTS

| | | | |
|---|---|---|---|
| 425,207 | 4/1890 | Bryne | 238/255 |
| 1,401,827 | 12/1921 | Stillwell | 238/255 |
| 3,374,974 | 3/1968 | Furrer et al. | 104/126 |
| 4,798,146 | 1/1989 | Roetzel | 104/111 |
| 4,928,602 | 5/1990 | Duczkowski, Jr. et al. | 104/111 |
| 4,934,276 | 6/1990 | Garpentin et al. | 104/111 |
| 5,009,168 | 4/1991 | Kuchta | 104/111 |
| 5,014,040 | 5/1991 | Bormann et al. | 104/111 |
| 5,188,036 | 2/1993 | Di Rosa | 104/111 |
| 5,355,805 | 10/1994 | Haab et al. | 104/106 |

FOREIGN PATENT DOCUMENTS

| | | | |
|---|---|---|---|
| 3338839 | 5/1985 | Germany | 104/111 |
| 3533835 | 11/1986 | Germany | 104/111 |

*Primary Examiner*—S. Joseph Morano
*Attorney, Agent, or Firm*—Nilles & Nilles, S.C.

[57] ABSTRACT

A splice plate for monorail track sections includes a mechanism for drawing the sections together and for leveling the top surfaces of the track with respect to one another. A hanger bracket which is used to attach the track to a support structure connects to the track without the use of through bolts thus eliminating the need to predrill holes in the track in order to receive such bolts. The supports themselves are commercially available hardware items and thus are less expensive than supports which are specifically designed for monorail track.

35 Claims, 3 Drawing Sheets

MONORAIL TRACK STRUCTURE

FIELD OF THE INVENTION

The invention relates to hardware items such as a splice plate, a hanger bracket, and a track support which are used to join together and support sections of monorail track.

BACKGROUND OF THE INVENTION

The use of monorail tracks to support article transportation devices is known in the art. Such tracks are usually formed in a particular cross-section in order to provide a horizontal top rail section for supporting a carrier cell, as well as several vertical sections against which the carrier cell is braced in order to remain balanced on the top rail section. The track itself may be formed of extruded aluminum in straight or curved sections which must be linked together in order to construct a track path. When joining the sections together, it is important that the gap between the sections be kept to a minimum and that the top surface of adjoining track sections be absolutely level with one another. The track sections must also be mounted on supports which are attached to the floor or hung from the ceiling in order to position the track path at the proper height above the factory floor. The supports are usually custom designed to support the monorail track and thus add considerable expense to the overall system.

SUMMARY AND OBJECTS OF THE INVENTION

According to the invention, a track splice for monorail track is designed to draw adjacent rack sections together in order to minimize the gap between the sections. Adjustment means are provided of the track splice so that the top rail sections of two adjacent tracks may be leveled with respect to one another to provide smooth carrier cell travel on the finished track. A hanger bracket for attaching the monorail sections to a support structure is provided which attaches to the monorail track by a quarter-turn motion. As a result, the bracket does not require the use of bolts which pass through the bracket into the track and the track does not have to be pre-drilled in order to receive the bolts. The supports which attach the track relative to the floor or ceiling are commercially available rather than being custom designed and are thus less expensive than prior monorail track supports.

It is accordingly an object of the invention to provide a splice plate for monorail track sections which minimizes the gap left between the sections and allows for easy leveling of the top surface of the sections relative to one another.

It is another object of the invention to provide a hanger bracket for a monorail track which attaches to the track without the use of through-bolts thus simplifying installation procedures and reducing installation costs.

It is another object of the invention to provide a monorail track structure in which the supports used to couple the monorail to the floor are general-purpose supports not specifically designed for monorail use.

These and other objects of the invention will become apparent from the following detailed description in which reference numerals used throughout the description correspond to reference numerals found on the drawing figures.

DESCRIPTION OF THE PREFERRED EMBODIMENT

Figure 1:
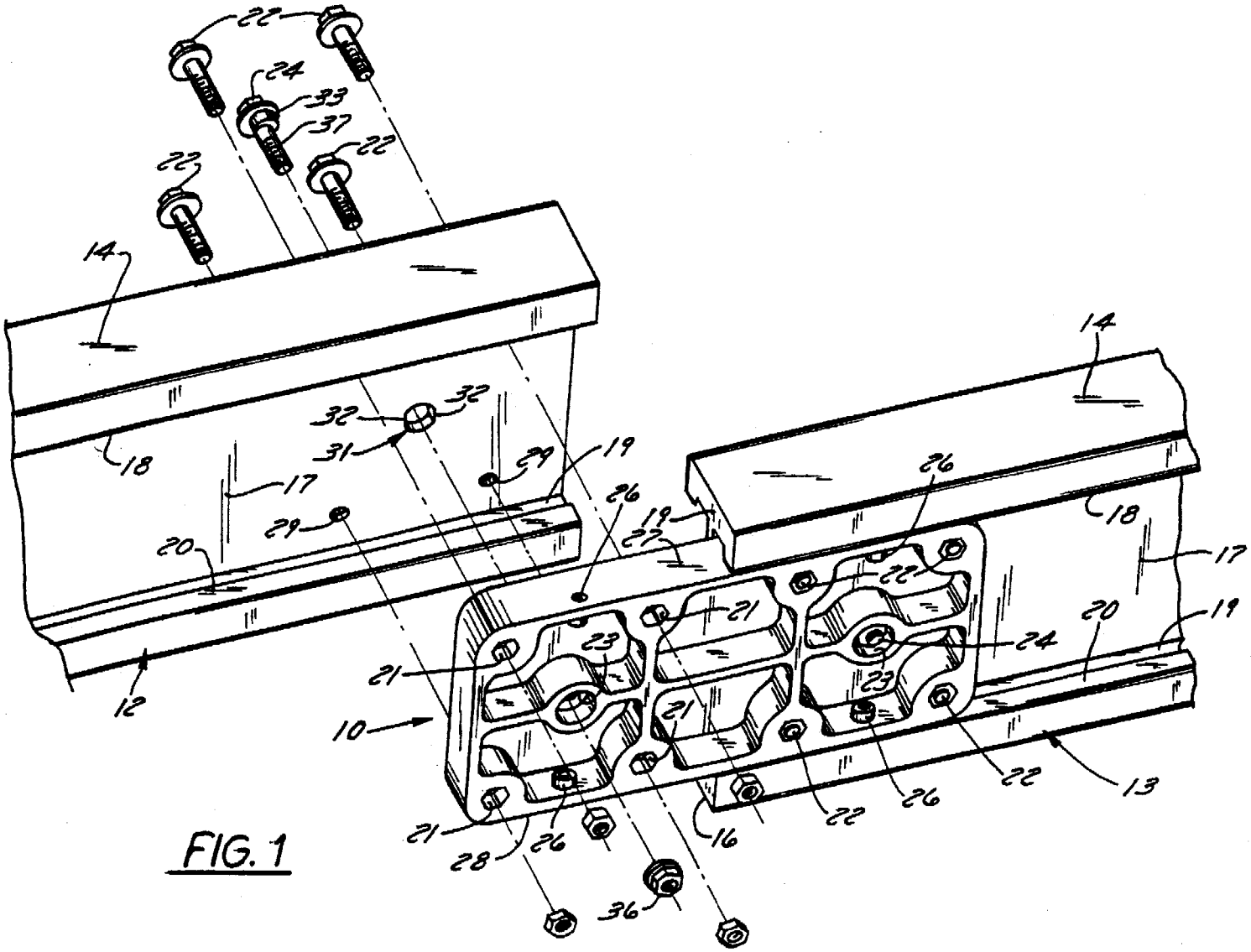
FIG. 1 is an exploded perspective view of two track sections and a splice plate according to the invention.
Figure 3:
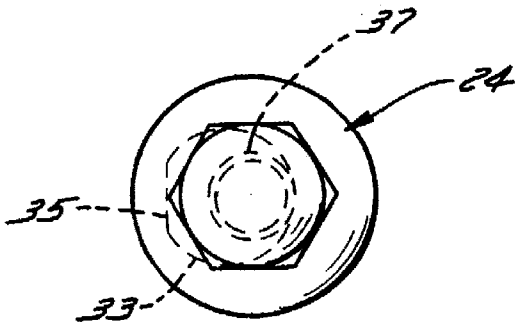
FIGS. 3 and 4 are top and side views, respectively, of a cam bolt used with the splice plate of FIG. 1.
Figure 4:
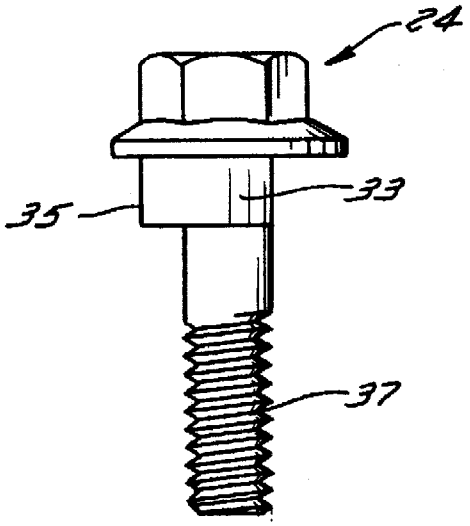
Figure 2:
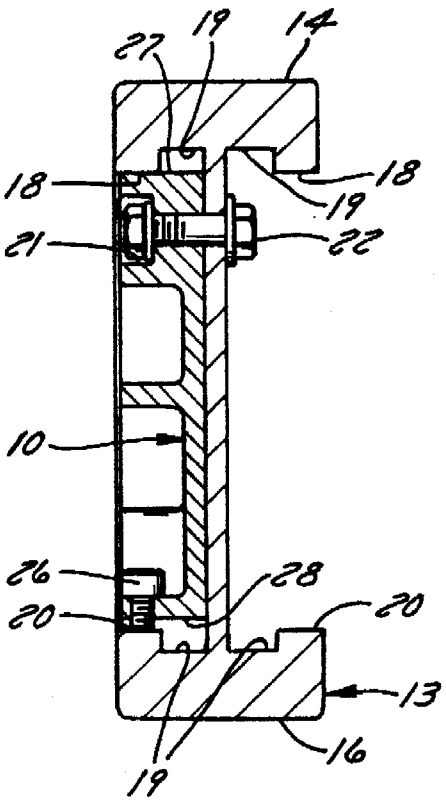
FIG. 2 is a side sectional view of a splice plate attached to a track section.

Turning now to the drawings, FIG. 1 shows a splice plate generally designated by the reference numeral 10. The splice plate 10 is shown joining together two track sections 12 and 13. Each track section comprises an upper rail 14 having an upper shoulder 18, a lower rail 16 having a lower shoulder 20, and an intermediate web portion 17 joining the upper and lower rails together. As shown in FIG. 2, the upper and lower shoulders 18 and 20 are each separated from the web by an undercut 19. The splice plate 10 is generally rectangular in shape and includes eight apertures, 21 for receiving through-bolts 22 which attach the splice plate to the two rail sections, The splice plate also includes two pilot holes 23 which receive two cam bolts 24 which are used to minimize the gap between two joined track sections. The splice plate also includes four adjustment screws 26, two of which are located along the top edge 27 of the splice plate and seat against the upper shoulder 18 and two of which are located along the bottom edge 28 and seat against the lower shoulder 20. The web portion of the track section ends are pre-drilled in a pattern of holes which corresponds to the holes in the splice plate so that the through-bolts 22 may be passed through the plate and the web. The web portion also includes non-circular holes 31 formed with straight sides 32 which receive the cam bolts 24, best seen in FIGS. 3 and 4. The cam bolts include an eccentric cam lobe 33 which fits into the non-circular hole in the track and a threaded shaft 37 which is received by the pilot holes in the splice plate.

In order to join two sections of track together, the splice plate is first assembled to the abutting ends of two track sections by hand-tightening the eight through bolts 22 to bring the splice plate and the two track sections into general alignment. The cam bolts 24 are then turned causing the flat face 35 on the cam lobe of each bolt to bear against the straight sides 32 of the non-circular holes to bring the two sections together and minimize the gap therebetween. Positioning the flat face 35 of the cam lobe against the straight side 32 of the non-circular hole provides tactile feedback to the installer that the cam bolt is in the home position and that the maximum travel of the two track sections toward each other has been achieved. The flat face 35 also acts as a locking feature to maintain the cam bolts in the home position. The nut 36 on the threaded shaft 37 of the cam bolts are then tightened to hold the cam bolts from moving out of the home position. The lower adjustment screws 26 are then used to force the lop edge 27 of the splice plate into contact with the upper track shoulder 18. In the event that the top rails of the two track sections are not at exactly the same level due to a slight twist in the track sections, the upper adjustment screws 26 are tightened to bring about the desired compensation. The remaining adjustment screws 26 are then tightened to prevent the two track sections from slipping vertically. The eight through bolts 22 are then finally tightened to secure the joint between the two track sections.

Figure 6:
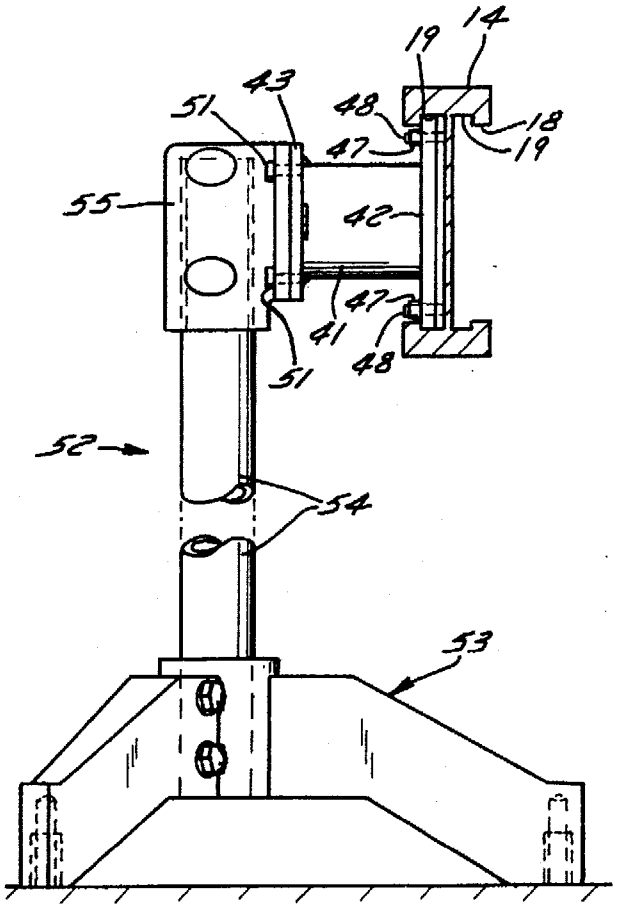
FIG. 6 is a side view of a hanger bracket coupling a track section to a floor support.
Figure 5:
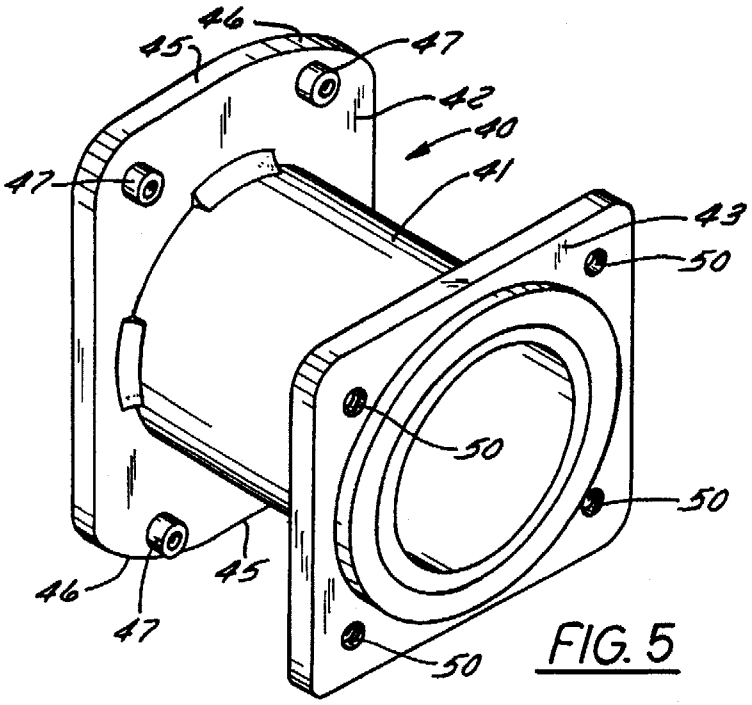
FIG. 5 is a perspective view of a hanger bracket.

Turning now to FIGS. 5 and 6, the hanger bracket is generally designated by the reference numeral 40. The hanger bracket includes a tubular body 41 which acts as a stand-off between the head 42 of the bracket which attaches to the track and the foot 43 of the bracket which attaches to a support. The head of the bracket is generally rectangular in shape and is characterized by two flanges 45 each of which has a truncated or rounded corner 46. Four threaded holes 47 are formed in the head of the hanger bracket to receive set screws 48 for securing the bracket to the monorail track as described more fully below. The foot 43 of the hanger bracket 40 is generally square and includes a threaded hole 50 in each corner thereof to receive bolts 51 to attach the foot to a support member.

Figure 7:
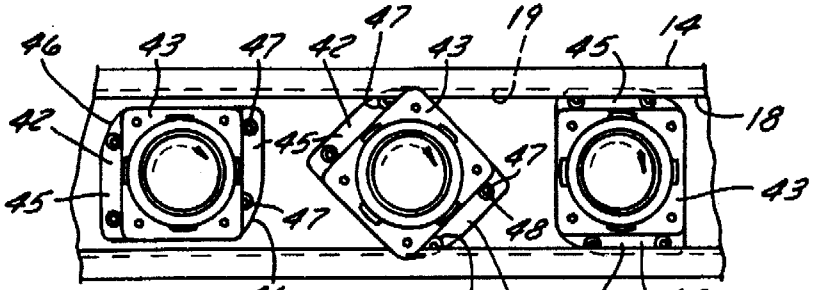
FIG. 7 shows the steps of attaching a hanger bracket to a track section.

FIG. 7 shows the process of attaching the head 42 of the hanger bracket to a monorail track. As shown in the left drawing, the head is placed against the web 17 of the track in a position with the flanges 45 on the left and right sides of the bracket with the set screws 48 not yet installed in the two threaded holes 47 which are located in each of the truncated corners 46. As shown on the middle and right drawings, the bracket is then rotated 90 degrees in a clockwise direction to position the flanges in the top and bottom undercut 19 formed between the shoulder and the web of the track. Set screws 48 may now be threaded into the holes 47 in the truncated corners to prevent the head from rotating counterclockwise since the set screws will interfere with the shoulders 18 and 20. The four set screws 48 may then be tightened against the web of the track to prevent the hanger bracket from rotating counterclockwise thus locking the hanger bracket in place. As a result, the hanger bracket can be securely attached to the track section without the use of bolts which pass through the track thus eliminating the need to pre-drill holes in the track. It will be appreciated by those skilled in the art that the truncated corners 46 of the flanges allow the bracket to be twisted into engagement with the undercut of the track at any location along the length of the track without having to insert the flanges into the undercut at one end of the track and then thread the head of the bracket along the undercut to the desired position along the track.

The four holes 50 in the foot of the hanger bracket are used to receive through bolts 51 to attach the bracket to commercially available tripod supports 52, shown in FIG. 6, which are sold for other purposes. Each tripod support includes a tripod foot section 53, a body 54, and a coupling 55 which attaches to the hanger bracket as described above. Although the tripod supports are shown in an orientation which would be used to support the monorail track on a floor, those skilled in the art will realize that the tripod support or an adaptation thereof may also be used in an inverted position to support the monorail track from a ceiling or other overhead support.

Having thus described the invention, various alterations and modifications will become apparent to those skilled in the art which modifications and alterations are intended to be within the scope of the instant invention as defined by the appended claims.

What is claimed:

1. A monorail track structure for a monorail vehicle including two sections of monorail track abutted end to end, the monorail track structure comprising:

a splice plate covering the joint between the two track sections, means for fastening the splice plate to the track sections, and cam means for drawing the two track sections together by directly applying opposing longitudinal forces to said splice plate and to at least one of said track sections.

2. The monorail track structure of claim 1 further comprising:

a cam bolt comprising the cam means, whereby the cam bolt may be turned against a cam surface in the track in order to draw the two track sections together.

3. A monorail track structure for a monorail vehicle including two sections of monorail track abutted end to end, the monorail track structure comprising:

a splice plate covering the joint between the two track sections, means for fastening the splice plate to the track sections, a cam bolt passing through the splice plate and at least one of the track sections for enabling the two track sections to be drawn together by turning the cam bolt against a cam surface on the monorail track structure, and adjustment screw leveling means for leveling the top surface of the two track sections with one another.

4. The monorail track structure of claim 3 wherein each of the track sections has a central web and an upper and lower shoulder which protrude from the web of the track and the adjustment screw means seat against the shoulders.

5. The monorail track structure of claim 4 wherein the splice plate attaches to the monorail track by means of through bolts which pass through the splice plate and the track.

6. The monorail track structure of claim 4 wherein the cam bolts have an eccentric cam surface which bears against a flat surface on the monorail track to draw the two track sections together.

7. The monorail track structure of claim 6 wherein the flat surface of the monorail track against which the cam bolts bear is formed on the side of a through hole formed in the monorail track.

8. The monorail track structure of claim 3 wherein each cam bolt has a head, an elongate and generally cylindrical shank extending outwardly from the head with a portion of the shank being of generally circular cross section and another portion of the shank being of substantially non-circular cross section defining a cam surface which bears against a cam receiving surface on the monorail track to draw the two sections together when the cam bolt is turned.

9. The monorail track structure of claim 8 wherein the cam surface is an eccentric carried by the shank.

10. A monorail track structure for a monorail vehicle carried by the track structure including two sections of monorail track generally abutted end to end, the monorail track structure comprising:

a splice plate covering the joint between the two track sections and carried by at least one of the track sections, and a cam bolt passing through the splice plate and one of the track sections oriented such that the longitudinal axis of the cam bolt is generally transverse to the longitudinal axis of the one track section with the cam bolt engaging the splice plate and the one track section for axially displacing the one track section toward the other track section to draw the end of the one track section toward the end of the other track section by turning the cam bolt such that engagement between the cam bolt, splice plate and the one track section displaces at least one of the track sections in a direction generally transverse to the longitudinal axis of the cam bolt.

11. The monorail track structure of claim 10 wherein the cam bolt is a bolt having an elongate shank extending generally outwardly from a head of the bolt and a cam lobe carried by the shank that bears against a cam surface on the one track section to displace the one track section toward the other track section when the bolt is turned.

12. The monorail track structure of claim 11 wherein each track section has a rail for carrying a vehicle and a web extending outwardly from the rail with the web of the one track section having a cam bolt receiving bore possessing a pair of spaced apart generally straight sides with at least one of the straight sides forming the cam surface and the splice plate (1) has a cam bolt receiving bore and (2) is located on one side of the web with its cam bolt receiving bore in registry with the cam bolt receiving bore of the web, and the cam lobe of the cam bolt is disposed on the shank adjacent the head of the cam bolt wherein the cam bolt is inserted through both cam bolt receiving bores from the side of the web opposite the splice plate such that the cam lobe of the cam bolt engages one of the straight sides of the cam bolt receiving bore in the web when the cam bolt is rotated.

13. The monorail track structure of claim 12 wherein each track section has a cam bolt receiving bore in registry with a cam bolt receiving bore in a portion of the splice plate covering that part of the track section and further comprising at least two cam bolts with (a) a cam bolt received through the cam receiving bore in one of the track sections and the corresponding splice plate portion and (b) a cam bolt received through the cam receiving bore in the other of the track sections and the corresponding splice plate portion.

14. The monorail track structure of claim 13 further comprising, for each track section, another rail carried by the web opposite the vehicle carrying rail with each rail having at least one shoulder that extends outwardly from the web and for each track section at least one adjustment screw carried by the splice plate which seats against the shoulder of one rail of the track section and at least one adjustment screw carried by the splice plate which seats against the shoulder of the other rail of the track section wherein each adjustment screw can be displaced inwardly or outwardly relative to the splice plate to level the vehicle carrying rail of one track section with the vehicle carrying rail of the other track section.

15. The monorail track structure of claim 12 further comprising a flat face on the cam lobe that is constructed and arranged to bear against one of the straight sides of the cam bolt receiving bore of the web to provide a home position of rotation of the cam bolt which indicates that the maximum travel of the track section relative to the other track section has been reached and which cooperates with the straight side of the bore to resist rotation of the cam bolt away from the home position.

16. The monorail track structure of claim 10 further comprising at least one through bolt which passes through the plate and one of the track sections to attach the splice plate to the track section wherein the through bolt is substantially hand tightened before turning the cam bolt and is further tightened after turning the cam bolt.

17. A track structure for a monorail vehicle comprising a monorail which is supported for vehicle use, the track structure comprising:

a monorail track comprising a top rail, a bottom rail and a web portion between the top rail and bottom rail, a hanger bracket comprising a head, a foot portion and a body and having a longitudinal axis extending generally from the foot portion toward the head, and wherein the head is constructed and arranged to be received adjacent the web between the bottom rail and the top rail of the track and rotated generally about the longitudinal axis of the hanger bracket until the head engages the track coupling the head to the track.

18. The track structure of claim 17 wherein (a) the head is a plate of generally rectangular construction comprising a pair of flanges and having four corners with two corners generally lying along a diagonal of the head plate and being truncated for providing clearance to enable the head plate to be rotated generally about the longitudinal axis of the hanger bracket with the head plate received between the top rail and bottom rail, and (b) the flanges of the head plate engage the track when the head plate is (1) received between the top rail and bottom rail and (2) rotated generally about the longitudinal axis of the hanger bracket such that one of the truncated corners is rotated toward the top rail and the other of the truncated corners is rotated toward the bottom rail until the flanges engage the track.

19. The track structure of claim 18 further comprising:

an upper shoulder formed on the top rail and a lower shoulder formed on the bottom rail, an undercut formed between each of the upper and lower shoulders and the web portion of the rail, and wherein upon rotation of the plate into engagement with the track, one of the flanges is received in the upper undercut and the other of the flanges is received in the lower undercut thereby coupling the hanger bracket to the track.

20. The track structure of claim 19 wherein the hanger bracket is coupled to the track without the use of fasteners which penetrate the track.

21. The track of claim 19 further comprising a threaded hole adjacent each truncated corner for each receiving a set screw to prevent rotation of the head portion when the flanges have been rotated into engagement with the track undercuts to prevent rotation of the head away from engagement with the track undercuts by the set screws bearing against a rail or a shoulder of a rail.

22. The track of claim 21 further comprising a threaded hole adjacent each of the other corners for each receiving a set screw that can be selectively extended from the head portion toward the web to bear against the web to lock the bracket to the track.

23. The track structure of claim 18 wherein the head portion is of integral construction.

24. The track of claim 18 wherein the body portion comprises a generally cylindrical tube connecting the head of the hanger bracket to the foot portion of the hanger bracket and the head is rotated about a longitudinal axis of the tube to couple the hanger bracket to the track.

25. The track of claim 18 further comprising a support carrying the hanger bracket.

26. The track of claim 25 wherein the support has a base, a body extending outwardly from the base and a coupling for engagement with the foot portion of the hanger bracket.

27. The track of claim 26 wherein the support is a tripod support having an elongate and generally tubular body extending outwardly from a tripod base and said coupling carried by said tubular body and secured to the foot portion of the hanger bracket to space the hanger bracket and track from the tripod base.

28. The track structure of claim 17 wherein the head comprises at least one flange formed on the head for coupling the hanger bracket to the track without the use of any fastener which penetrates the track.

29. The track structure of claim 17 wherein the head comprises at least one flange having a truncated corner constructed and arranged to couple the head portion to the track by enabling the flange to be rotated into engagement with one of the rails of the track.

30. The track structure of claim 17 further comprising:

an upper shoulder formed on the top rail and a lower shoulder formed on the bottom rail, an undercut formed between each of the upper and lower shoulders of the rail, and wherein the head portion comprises a pair of opposed flanges with each of the flanges formed with a truncated corner to enable each flange to be rotated into engagement with the undercuts.

31. The track flanges in a claim 30 wherein the undercuts oppose movement of the flanges in a direction outwardly away from the web of the track when rotated into engagement with the undercuts.

32. The track structure of claim 30 wherein each truncated corner is rounded to produce the truncation.

33. The track structure of claim 30 wherein the flanges are formed of a head portion that is of integral construction.

34. A track structure for a monorail vehicle comprising a monorail which is supported for vehicle use, the track structure comprising:

a monorail track comprising a top rail, a bottom rail and a web portion between the top rail and bottom rail, an upper shoulder formed on the top rail and a lower shoulder formed on the bottom rail, an undercut formed between each of the upper and lower shoulders and the web portion of the track, a hanger bracket comprising a head, a foot portion and a body portion, wherein the head is comprised of a pair of opposed flanges with each flange having a pair of corners with only one corner of each flange being truncated and the corners of the flanges arranged in a generally rectangular pattern, and wherein the flanges are received between the upper rail and lower rail and rotated such that one of the truncated corners is rotated toward the top rail and the other of the truncated corners is rotated toward the bottom rail until one of the flanges is received in the upper undercut and the other of the flanges is received in the lower undercut thereby coupling the hanger bracket to the track.

35. The track structure of claim 34 further comprising a bore in each flange for receipt of a set screw each of which can be selectively urged outwardly toward the web of the track to bear against the web to urge the flanges against the shoulders thereby locking the flanges in the undercuts by preventing rotation of the flanges.

* * * * *